US007167247B2

(12) United States Patent
Uemura et al.

(10) Patent No.: US 7,167,247 B2
(45) Date of Patent: Jan. 23, 2007

(54) PAPER QUALITY DISCRIMINATING MACHINE

(75) Inventors: Toshiro Uemura, Nissin (JP); Yoshitaka Takezawa, Hitachinaka (JP); Mitsunari Kano, Seto (JP); Eiji Mizuno, Owariasahi (JP); Toshiaki Nakamura, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 419 days.

(21) Appl. No.: 10/417,266

(22) Filed: Apr. 17, 2003

(65) Prior Publication Data

US 2003/0197866 A1 Oct. 23, 2003

(30) Foreign Application Priority Data

Apr. 22, 2002 (JP) ..... 2002-119439

(51) Int. Cl.

| | |
|---|---|
| ***G01N 21/00*** | (2006.01) |
| ***G01N 21/55*** | (2006.01) |
| ***G01N 21/86*** | (2006.01) |
| ***G06K 9/74*** | (2006.01) |
| ***G06K 9/00*** | (2006.01) |
| ***G01V 8/00*** | (2006.01) |

(52) U.S. Cl. ..... 356/432; 356/71; 356/72; 356/73; 356/445; 382/135; 250/559.4

(58) Field of Classification Search ..... 250/559.03–559.06, 559.16–559.18, 559.11, 250/559.01, 559.4, 559.44, 559.46; 356/432–435, 356/237.2, 445, 446, 72, 600; 347/16, 101; 358/434; 399/16, 389; 271/258.01; 355/407, 355/408

See application file for complete search history.

(56) References Cited

U.S. PATENT DOCUMENTS

| | | | | |
|---|---|---|---|---|
| 3,910,701 | A | 10/1975 | Henderson et al. | |
| 4,618,257 | A * | 10/1986 | Bayne et al. | 356/71 |
| 4,750,140 | A * | 6/1988 | Asano et al. | 382/108 |
| 5,027,415 | A | 6/1991 | Hara et al. | |
| 5,757,001 | A | 5/1998 | Burns | |
| 5,960,103 | A | 9/1999 | Graves et al. | |
| 6,325,505 | B1 * | 12/2001 | Walker | 347/105 |
| 6,677,603 | B1 * | 1/2004 | Yanagiuchi | 250/559.4 |

(Continued)

FOREIGN PATENT DOCUMENTS

CN 1295698 5/2001

(Continued)

*Primary Examiner*—Gregory J. Toatley, Jr.
*Assistant Examiner*—Gordon J. Stock, Jr.
(74) *Attorney, Agent, or Firm*—McDermott Will & Emery LLP

(57) ABSTRACT

The technique of the present invention enhances the stability of paper material identification of sheets. To achieve the above purpose, both short-wavelength light in the range of 370 nm and long-wavelength light in the range of 420 to 1000 nm are irradiated to paper to be identified in identifying the paper material. The identification is carried out, based on the difference in absorbance of the paper, which is obtained for each irradiated light. The absorbance of the paper varies according to the paper material, thereby enabling the identification of the paper material free from influence, which are caused by differences in manufacturing process, such as shading patterns. In addition, the simultaneous use of the short-wavelength light and the long-wavelength light declines influence on the absorbance, which are caused by environmental factors, such as humidity and deterioration of sheets, thereby resulting in stable identification of the paper material.

4 Claims, 10 Drawing Sheets

U.S. PATENT DOCUMENTS

| | | | | |
|---|---|---|---|---|
| 6,730,911 | B1 * | 5/2004 | Uemura et al. | 250/339.01 |
| 6,838,687 | B1 * | 1/2005 | Tullis et al. | 250/559.07 |
| 6,839,128 | B1 * | 1/2005 | Premjeyanth et al. | 356/71 |
| 6,914,684 | B1 * | 7/2005 | Bolash et al. | 356/600 |
| 2002/0191175 | A1 * | 12/2002 | Coombs et al. | 356/71 |

FOREIGN PATENT DOCUMENTS

| | | | |
|---|---|---|---|
| EP | 0 990 890 | A | 4/2000 |
| EP | 1 049 055 | A2 | 11/2000 |
| JP | 61-233889 | | 10/1986 |
| JP | 63-158442 | | 7/1988 |
| JP | 63-187138 | | 8/1988 |
| JP | 7-260680 | | 10/1995 |
| JP | 08-180189 | | 7/1996 |
| JP | 11-139620 | | 5/1999 |
| JP | 2003-77026 | A | 3/2003 |
| WO | WO99/50796 | | 10/1999 |
| WO | WO 99/50796 | A | 10/1999 |
| WO | WO 01/54077 | A1 | 7/2001 |

* cited by examiner

PAPER QUALITY DISCRIMINATING MACHINE

BACKGROUND OF THE INVENTION

1. Field of the Invention

The present invention relates to a machine and a method for identifying paper quality, to be more precise, paper material.

2. Description of the Related Art

One method to discriminate genuine from counterfeit about sheets, such as banknotes, for example, is performed by judging as to whether or not the material of sheets are proper. As to well known in the art, there is a technique of identifying the paper material, based on optical scanning of lattice shading patterns of the paper, which is caused by fibrous structure of the paper (e.g. JP8-180189A discloses those techniques). Another technique in the art is to identify the paper material according to the difference of the time required for transmitting sheets, which is caused by the difference of the frictional force corresponding to each paper material (e.g. JP11-139620A discloses those techniques).

SUMMARY OF THE INVENTION

Those skilled in the art, however, fail to attain stable identification of paper material sufficiently. In some cases of the first technique, the variation of shading patterns, which are caused by differences in manufacturing process, resulted in misjudgments about the paper material. On the other hand, in some cases of the latter technique, the variation of frictional force, which is caused by variable humidity and deterioration of sheets, resulted in misjudgments about the paper material.

The object of the present invention is thus to provide a machine and a method for identifying the paper material stably.

To attain at least part of the above and the other related objects in the present invention, the technique of the present invention directs to irradiate plural kinds of irradiated light to paper to be identified, each kind of the irradiated light included in a different waveband. This technique identifies the paper material, based on an evaluation value calculated according to a prescribed arithmetic expression including the plurality of absorbance of the paper corresponding to each kind of the irradiated light. Since the absorbance of paper varies depending on the paper material, the absorbance, in contrast to the shading patterns of the paper, enables the identification of the paper material free from the influence of differences in manufacturing process. In addition, the plural kinds of the irradiated light in different wavebands may reduce the influence on the absorbance, caused by environmental factors, such as humidity, and deterioration of sheets, thereby resulting in stable identification of the paper material.

Here, the absorbance means the ratio between the intensity of the irradiated light L0 and that of the light L transmitted through the paper or reflected from the paper, and is defined as e.g. "Absorbance=log (L/L0)". It is also possible to be defined as "Absorbance=L/L0". The absorbance may be detected by means of a transmission method that is measured by the transmitted light through the paper or a reflection method that is measured by the reflected light from the paper.

The wavebands of the irradiated light may be arbitrary set according to the purpose of identifying the paper material, that is, what kind of paper material is to be identified. The present invention is thus applicable to discriminate genuine from counterfeit about banknotes and other prescribed sheets. In those cases, the wavebands may be selected so that the absorbance of genuine paper material significantly differs from that of any other paper materials since it is only required to judge as to whether or not the identified paper is genuine material.

The irradiated light preferably includes short-wavelength light within the ultraviolet light range and long-wavelength light within the visible light or the infrared light range. It is because the short-wavelength light tends to make the absorbance of each paper material typically distinctive, and the long-wavelength light tends to make the absorbance less sensitive to the environmental factors, such as humidity, and deterioration of paper. The combination of both types of the light thus improves the stabilization as well as the accuracy for identifying the paper material. In particular, it is preferable that the center wavelength of the short-wavelength light is in the range of 370±10 nm, and the long-wavelength light is in the range of 420 to 1000 nm.

In the present invention, the prescribed arithmetic expression includes at least one out of two parameters, DA or Ar, which are respectively calculated from the following arithmetic expressions.

$$DA=A1-Ca\cdot A2;\text{ and}$$

$$Ar=A1/A2$$

Here, A1 and A2 respectively represents the plurality of absorbance responsive to the irradiated light in two different wavebands, and Ca is an arbitrary positive number. Those evaluation values corresponding to the paper material are stored in advance, so that the paper material may be judged by comparing the stored values with the evaluation values being calculated from the absorbance corresponding to the paper to be identified.

A variety of the structures may be adopted for the present invention. For example, the present invention may be attained by a paper material identifying machine for identifying the paper material based on the above-mentioned policy, or a method for identifying the paper material. Further, it is also applicable to be constructed as a paper identifying machine and a method for identifying genuine from counterfeit about banknotes, based on a result from the identification about the paper material.

DESCRIPTION OF THE PREFERRED EMBODIMENTS

Some modes of performing the present invention are discussed below as preferred embodiments.

A. General Construction

Figure 1:
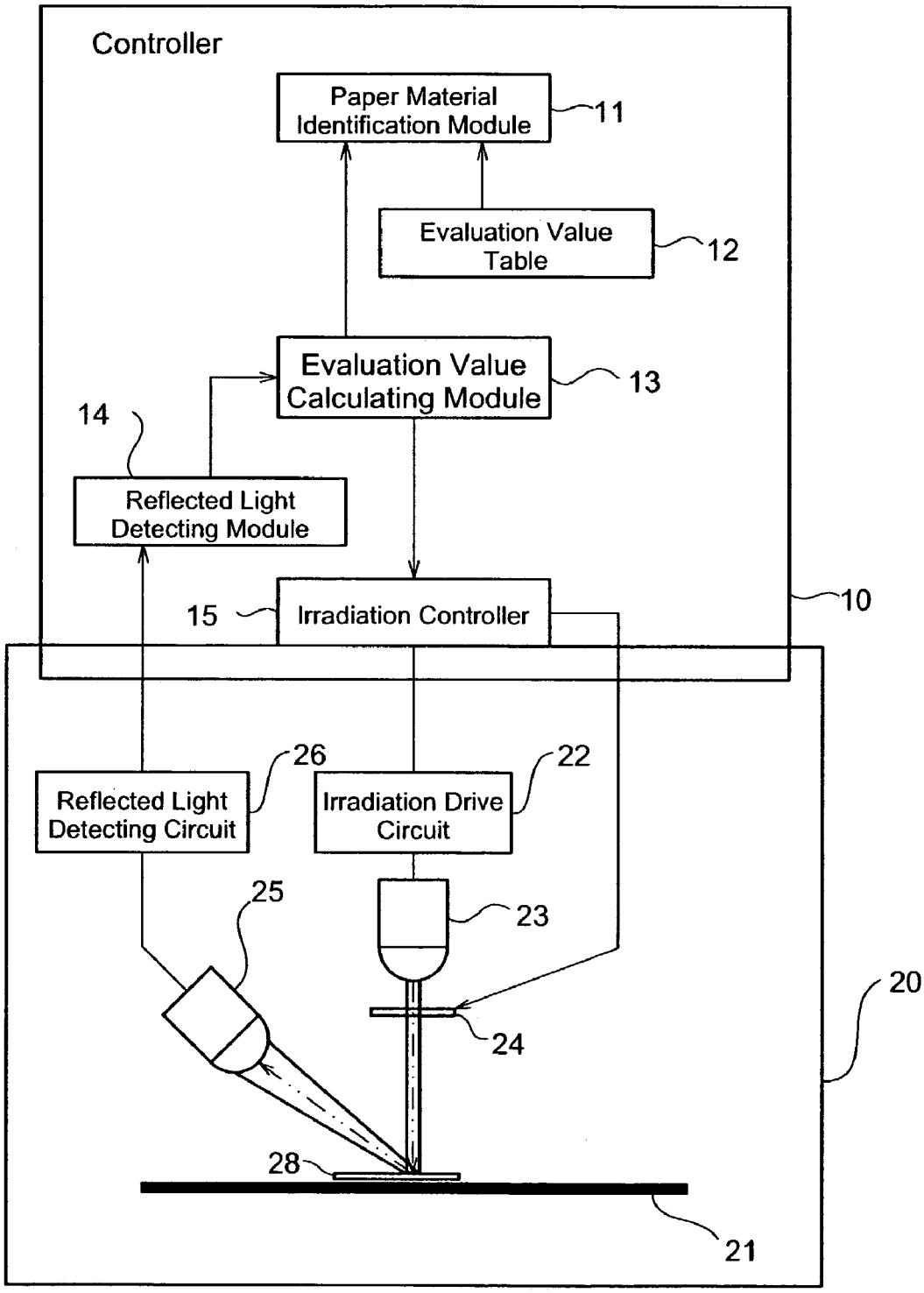
FIG. 1 is a schematic of the structure of a paper material identifying machine.

FIG. 1 is a schematic of the structure of a paper material identifying machine. The paper material identifying machine comprises an optical unit 20 and a controller 10.

The optical unit 20 includes a light source 23 in order to irradiate irradiated light that is used for identifying material of sheets, such as banknotes. In this embodiment, the identification is performed using two different kinds of irradiated light. The spectrum of the first kind of the irradiated light, the center wavelength of which is 370 nm, distributes within the range of 370±10 nm (Hereinafter referred to as "short-wavelength light"). The spectrum the second kind of the irradiated light, the center wavelength of which is within the range of 420 to 1000 nm, distributes within the range of ±20 nm from the center wavelength (Hereinafter referred to as "long-wavelength light"). In either types, the wavelength of the light may be selected experimentally or analytically so as to obtain the value most suitable for the paper material of the sheet to be identified.

In this embodiment, two different kinds of the irradiated light are obtained by switching over a filter 24 through which the light irradiated from the single light source 23 passes. It is also applicable to install two light sources for irradiating restrictive light in different wavebands.

It is possible to apply various devices to the light source 23: an integrated sphere, a light emitted diode, an ultraviolet lump, an infrared light emitted diode or the like. The light source 23 is activated by an irradiation drive circuit 22. The irradiation drive circuit 22 is configured to impress the voltage according to a control signal from the controller 10. The irradiation drive circuit 22 may vary impedance based on the control signal, thereby enabling the adjustment of the amount of emission from the light source 23.

When a sheet 28 is located on a conveyance path 21, the irradiated light is reflected on the surface of the sheet 28. The optical unit 20 includes a light receiver 25, for detecting the intensity of the reflected light, and a reflected light detecting circuit 26. It is possible to apply a photo transistor, a photo diode, a magnetic spectrophotometer or the like to the light receiver 25. It is possible to apply, for example, A/D converter, which converts an analog signal such as the voltage being output from the light receiver 25 to a digital signal, to the reflected light detecting circuit 26.

Figure 1A:
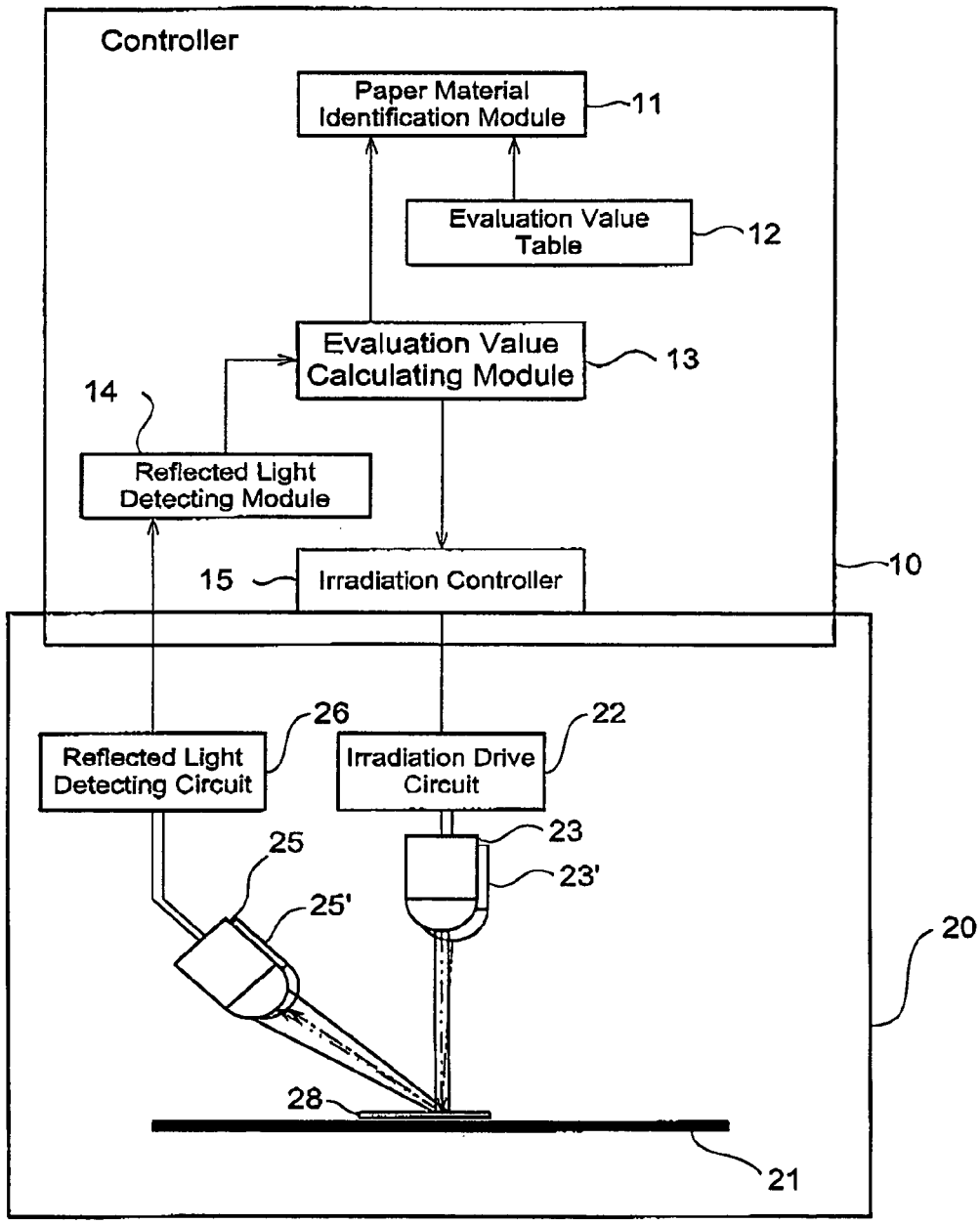
FIG. 1A is a schematic of a variation of the structure of a paper material identifying machine of FIG. 1.

FIG. 1A illustrates a variation of the machine shown in FIG. 1, that comprises a plurality of irradiating light sources 23 and 23' that output light of different wavebands. Light reflected from surface 28 is detected for each waveband by a respective light receiver 25 or 25' in conjunction with reflected light module 14.

Figure 2:
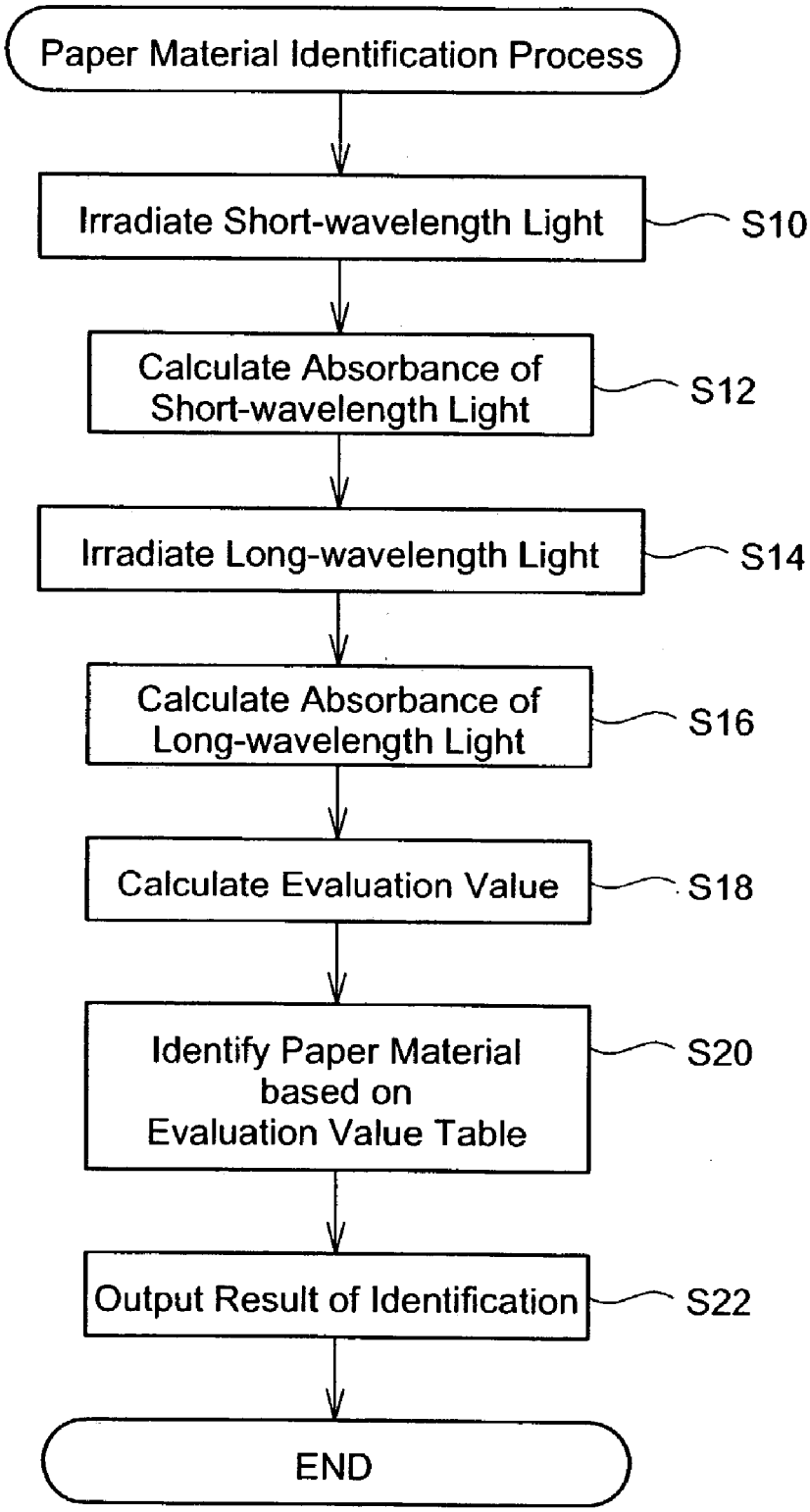
FIG. 2 is a flow chart of a processing of paper material identification.

B. Processing of Paper Material Identification:

FIG. 2 is a flow chart showing a processing of paper material identification that is performed by the controller 10 in response to the insertion of the sheet 28.

First, the controller 10 controls the irradiation drive circuit 22 in order to irradiate the short-wavelength light (Step S10). In the course of this processing, the controller 10 simultaneously controls the filter 24 in order to irradiate the short-wavelength light and the long-wavelength light in a sequential order. These functions are actualized by an irradiation controller 15. The irradiated light is reflected on the sheet 28, and then incidents into the light receiver 25. The controller 10 obtains the intensity of the reflected light for the short-wavelength light by the function of a reflected light detecting module 14. In addition, absorbance of the short-wavelength light Al is calculated from the following formula, based on intensity of the irradiated light L10 and the intensity of the reflected light L1 (Step S12).

$$A1=\log(L1/L10);$$

Similarly, the controller 10 controls the irradiation drive circuit 22 in order to irradiate the long-wavelength light (Step S14), and calculates absorbance of the long-wavelength light A2 from the following formula, based on intensity of the irradiated light L20 and the intensity of the reflected light L2 (Step S16).

$$A2=\log(L2/L20);$$

In this embodiment, the absorbance is defined as the inferior logarithm of the ratio between the irradiated light and the reflected light, however, the absorbance may be defined as the ratio between the irradiated light and the reflected light, that is, "A1=L1/L10" and "A2=L2/L20".

Subsequently, the controller 10 obtains an evaluation value for identifying the paper material, based on the above absorbance; A1 and A2 (Step S18). In this embodiment, the difference between two absorbance is used as an evaluation value, as follows.

$$\text{Evaluation value } DA=A1-A2$$

An evaluation value calculating module 13 functions to calculate the evaluation value based on the above arithmetic expression.

In this embodiment, the short-wavelength light and the long-wavelength light are irradiated in this order, however it is applicable to irradiate them in a reverse order. In addition, both the short-wavelength light and the long-wavelength light may be irradiated simultaneously if each absorbance corresponding to the light is distinguishable.

The controller 10 pre-stores an evaluation value table 12 that represents the relationship between the evaluation value and the paper material. An example of the evaluation value table 12 will be discussed later. The controller 10 identifies the paper material by comparing the evaluation value obtained on step 18 with the value stored in the evaluation value table 12 (Step S20). A paper material identification module 11 achieves this function. The controller 10 thus outputs the result of the identification (Step S22) and then terminates this processing.

C. Example of Evaluation Value

Figure 3:
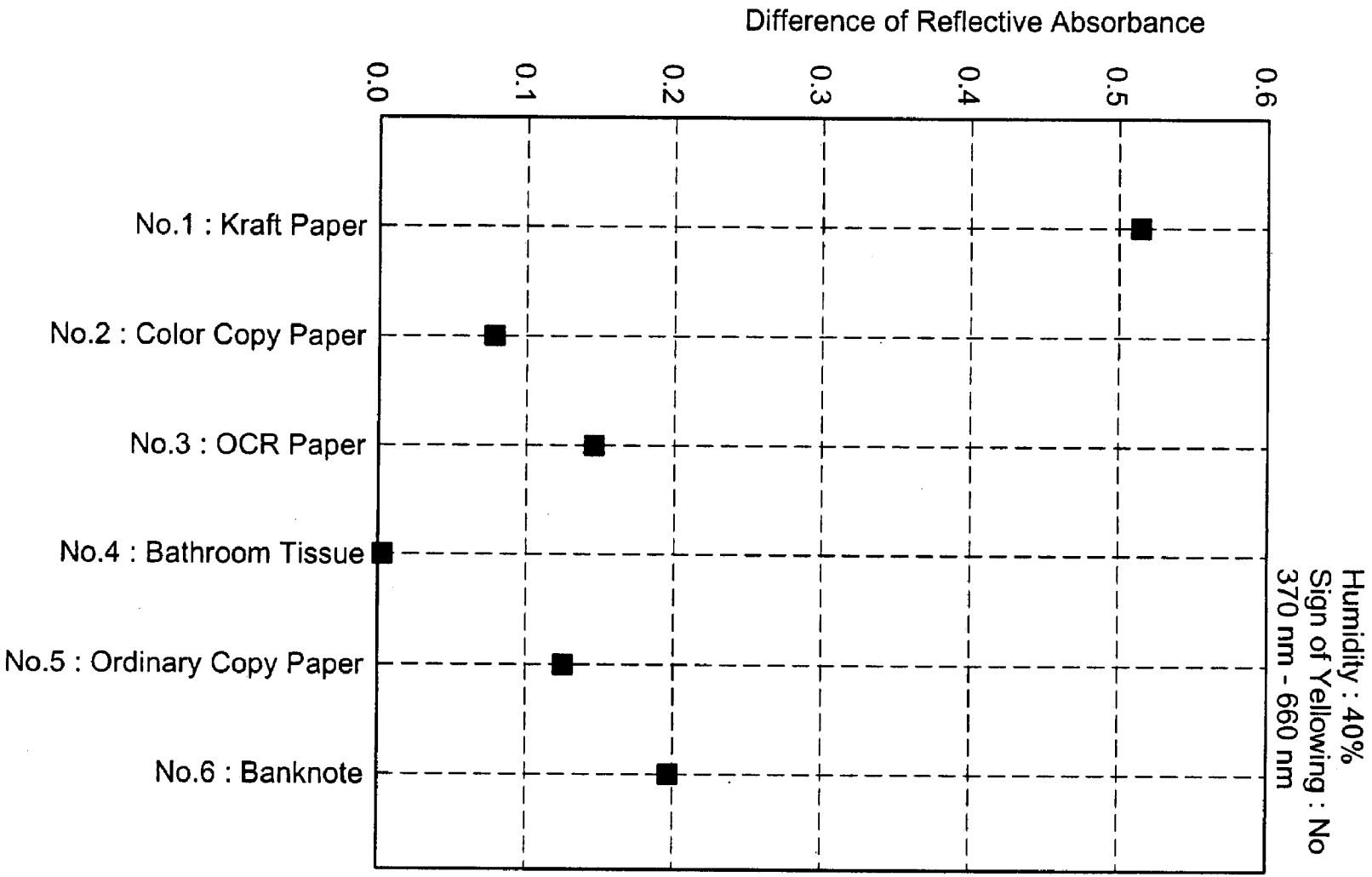
FIG. 3 is an explanatory diagram showing the relationship between evaluation values and paper material with 660 nm-long-wavelength-light.

FIG. 3 is an explanatory diagram showing the relationship between the evaluation value and the paper material with 660 nm-long-wavelength light. The figure shows the experimental result of the irradiation with 370 nm-short-wavelength-light and 660 nm-long-wavelength-light to six kinds of the paper material of sheets at a humidity of 40%. DA represents the difference between both absorbance. The light was emitted with a 150 mm-integrated-sphere. The light intensity was detected with a magnetic spectrophotometer. Each sheet number represents the paper material as follows;

| | |
|---|---|
| NO.1 | Kraft Paper |
| NO.2 | Color Copy Paper |
| NO.3 | OCR Paper |
| NO.4 | Bathroom Tissue |
| NO.5 | Ordinary Copy Paper |
| NO.6 | Banknote |

The result of this experimental test in FIG. 3 has shown that the evaluation values have been varied depending on the paper material. Thus, the paper material may be identified by storing the evaluation values into the evaluation value table 12 in advance. When the purpose of the identification is to judge as to whether or not the sheet 28 is genuine banknote, it is applicable to simply store value corresponding to the banknote into the evaluation value table 12, thereby enabling easy judgment as to genuine from counterfeit, based on whether or not the evaluation value of the sheet 28 matches the stored value.

Figure 4:
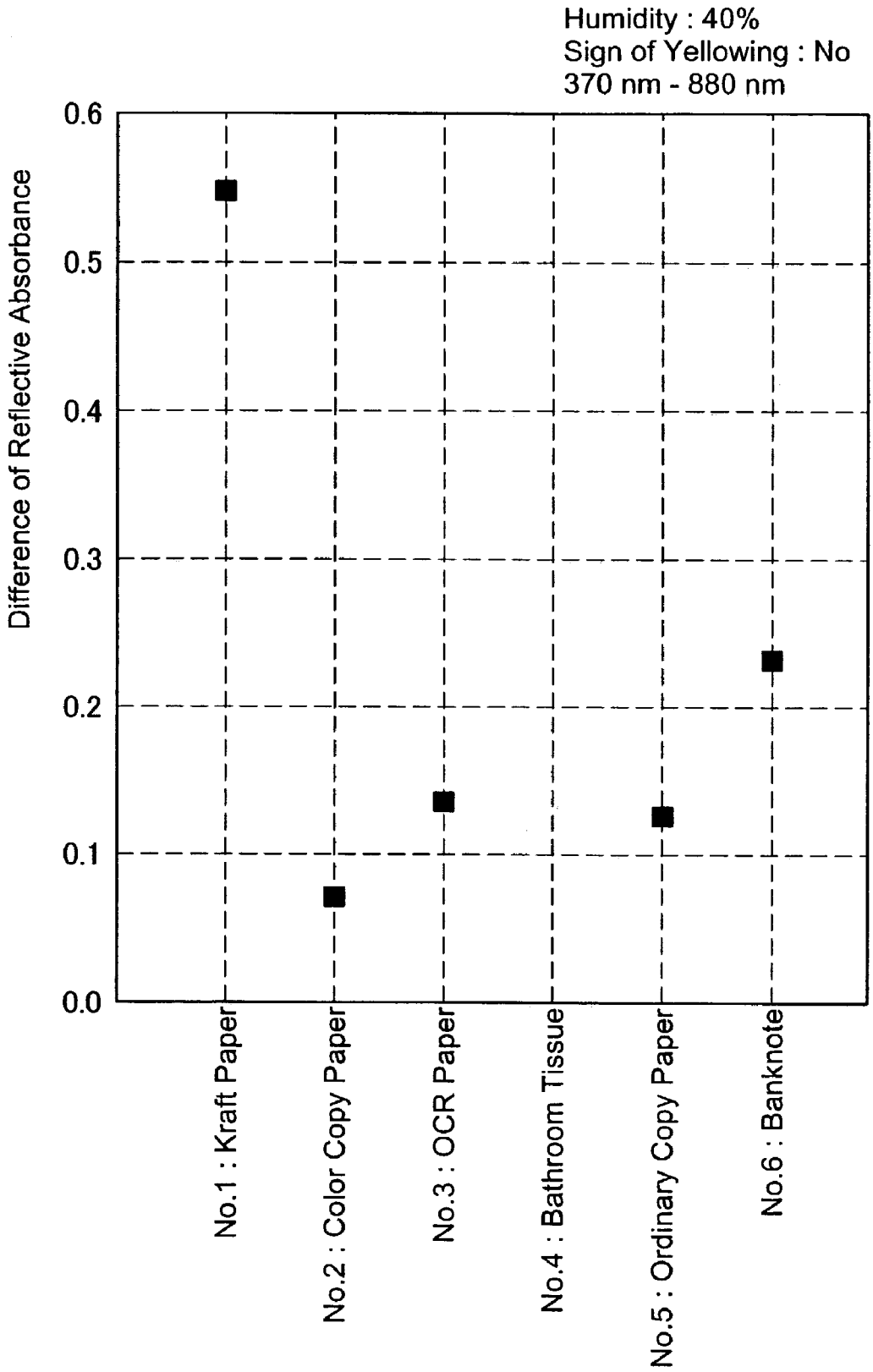
FIG. 4 is an explanatory diagram showing the relationship between evaluation values and paper material with 880 nm-long-wavelength-light.

FIG. 4 is an explanatory diagram showing the relationship between the evaluation values and the paper material with 880 nm-long-wavelength-light. The definitions of the short-wavelength light, the paper material to be identified, the condition of humidity and the evaluation values are the same as those of FIG. 3. FIG. 4 has also shown that the absorbance apparently has been varied depending on the paper material with 880 nm-light. It should be noted, however, that the difference between "No. 3: OCR Paper" and "NO. 5: Ordinary Copy Paper" is relatively small in this example, therefore, it is preferred not to apply this testing in the necessity that both types are to be identified.

Figure 5:
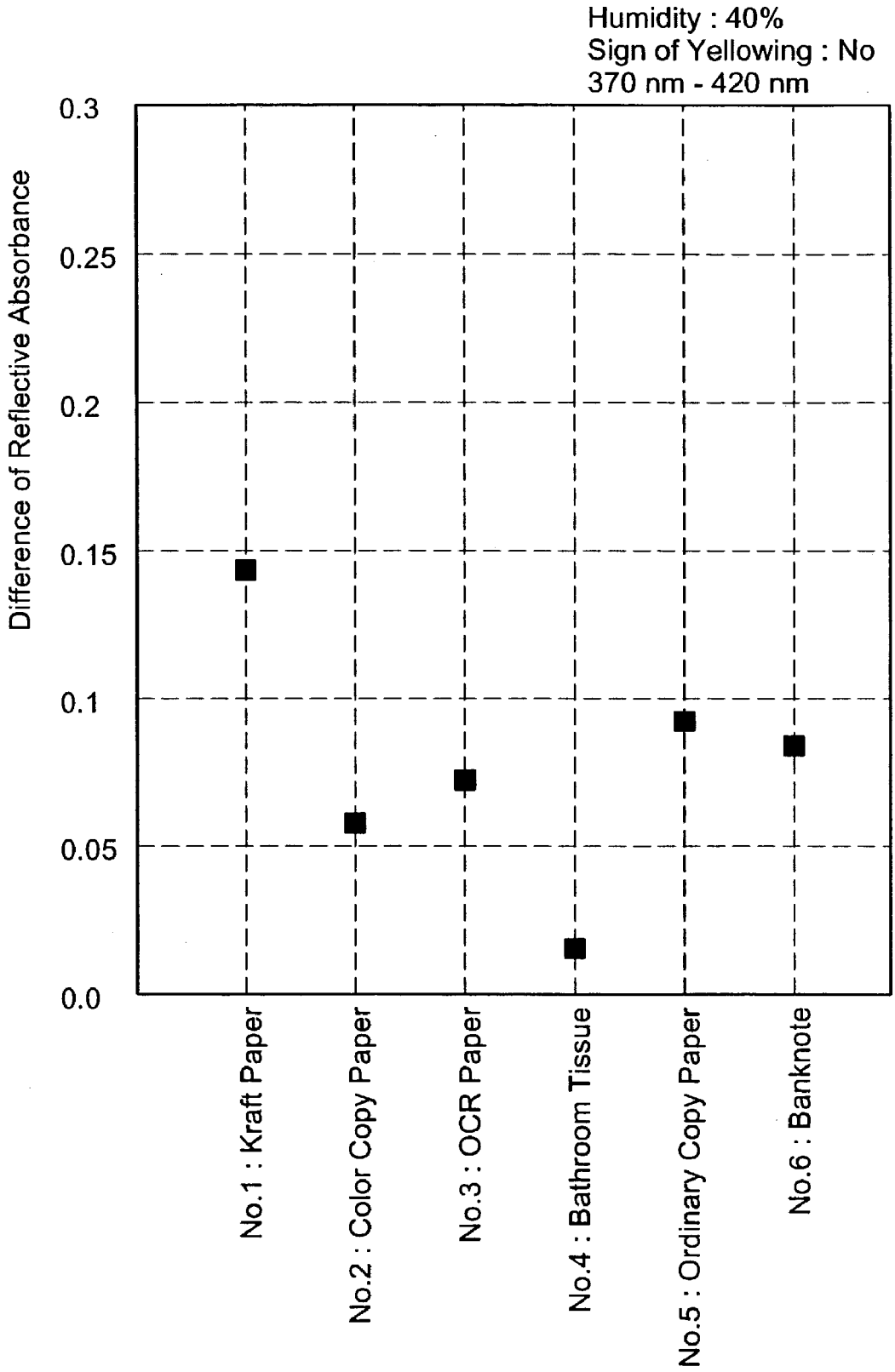
FIG. 5 is an explanatory diagram showing the relationship between evaluation values and paper material with 420 nm-long-wavelength-light.

FIG. 5 is an explanatory diagram showing the relationship between evaluation values and the paper material with 420 nm-long-wavelength-light. FIG. 5 has also shown that the absorbance apparently has been varied depending on the paper material with 420 nm-light. The difference between "NO. 5: Ordinary Copy Paper" and "No. 6: Banknote" is relatively small in this example, however, they are distinguishable each other.

Figure 6:
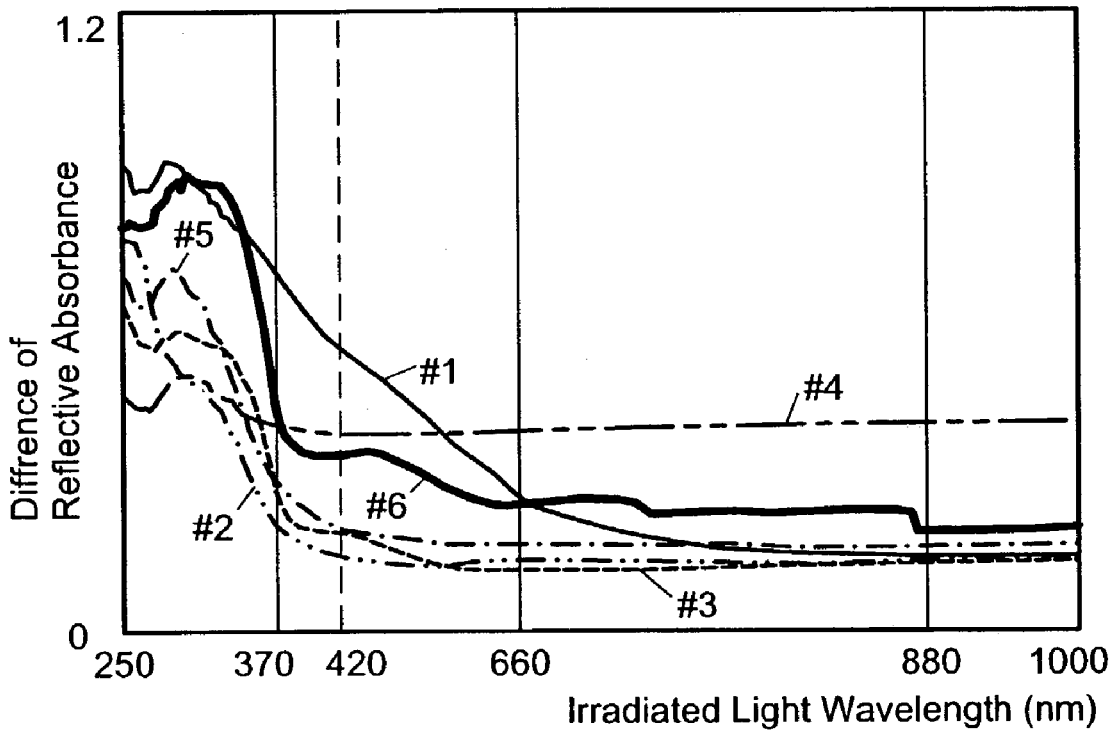
FIG. 6 shows a graph of the relationship between the wavelength of irradiated light and absorbance.

FIG. 6 shows a graph of the relationship between the wavelength of the irradiated light and the absorbance. FIG. 6 has shown the variation in the absorbance for the irradiated light within the range between 250 and 1000 nm about six kinds of papers to be identified in FIGS. 3 and 4. The irradiated light of 370 nm, 420 nm, 660 nm and 880 nm used in FIGS. 3 and 4 are shown here as well. As shown in FIG. 6, the absorbance in the range of 370 nm steeply varies as the wavelength varies. In the range of 420 nm to 660 nm, the absorbance of some papers are constant, and others are varying. In the range over 660 nm, the absorbance is nearly constant. Therefore, it is possible to obtain the patterns similar to one out of examples in FIGS. 3 through 5 or interpolating them, thereby enabling the identification of the paper material.

Figure 7:
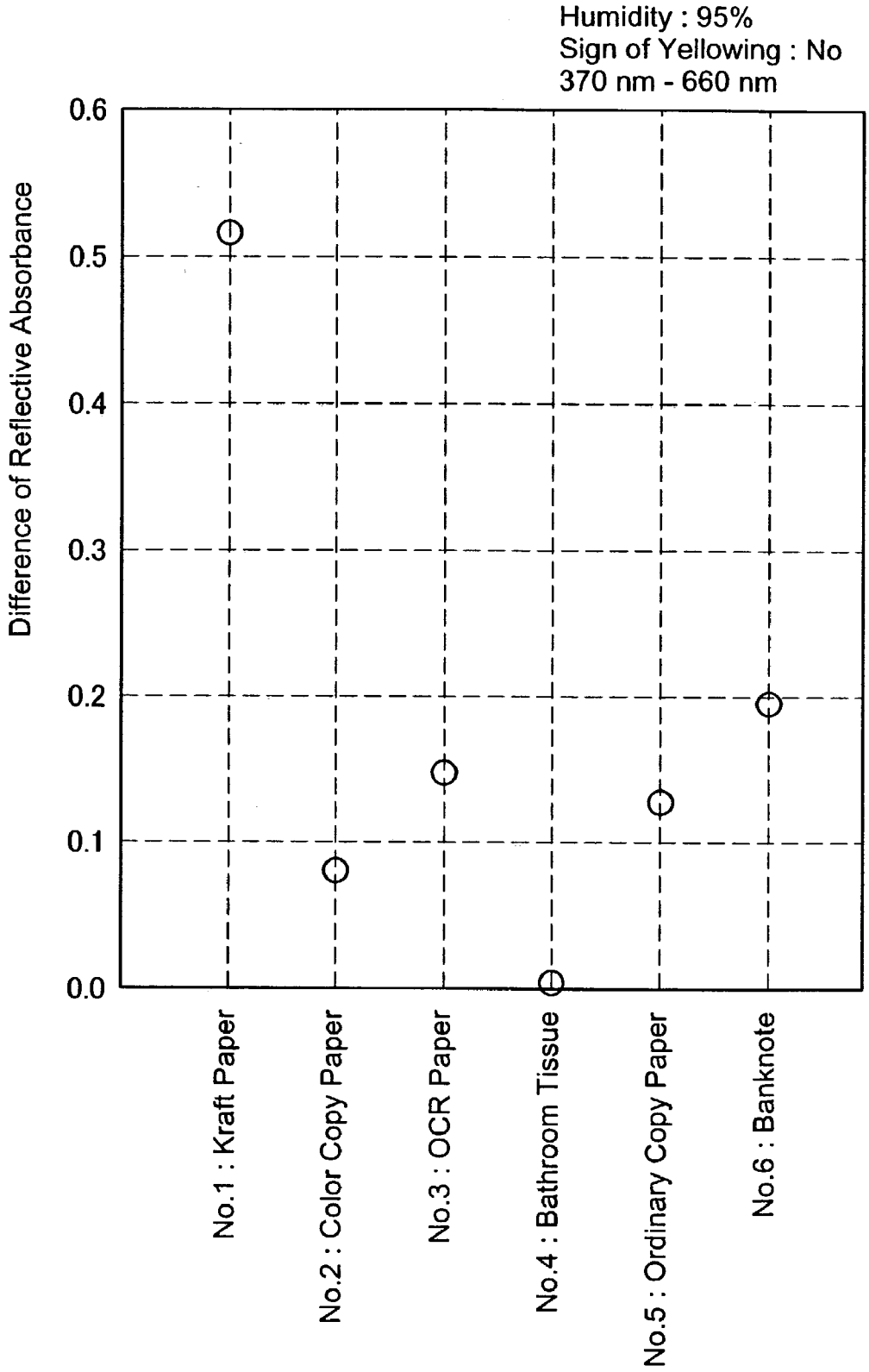
FIG. 7 is an explanatory diagram showing the effect on evaluation values in the case of varying moisture content.
Figure 8:
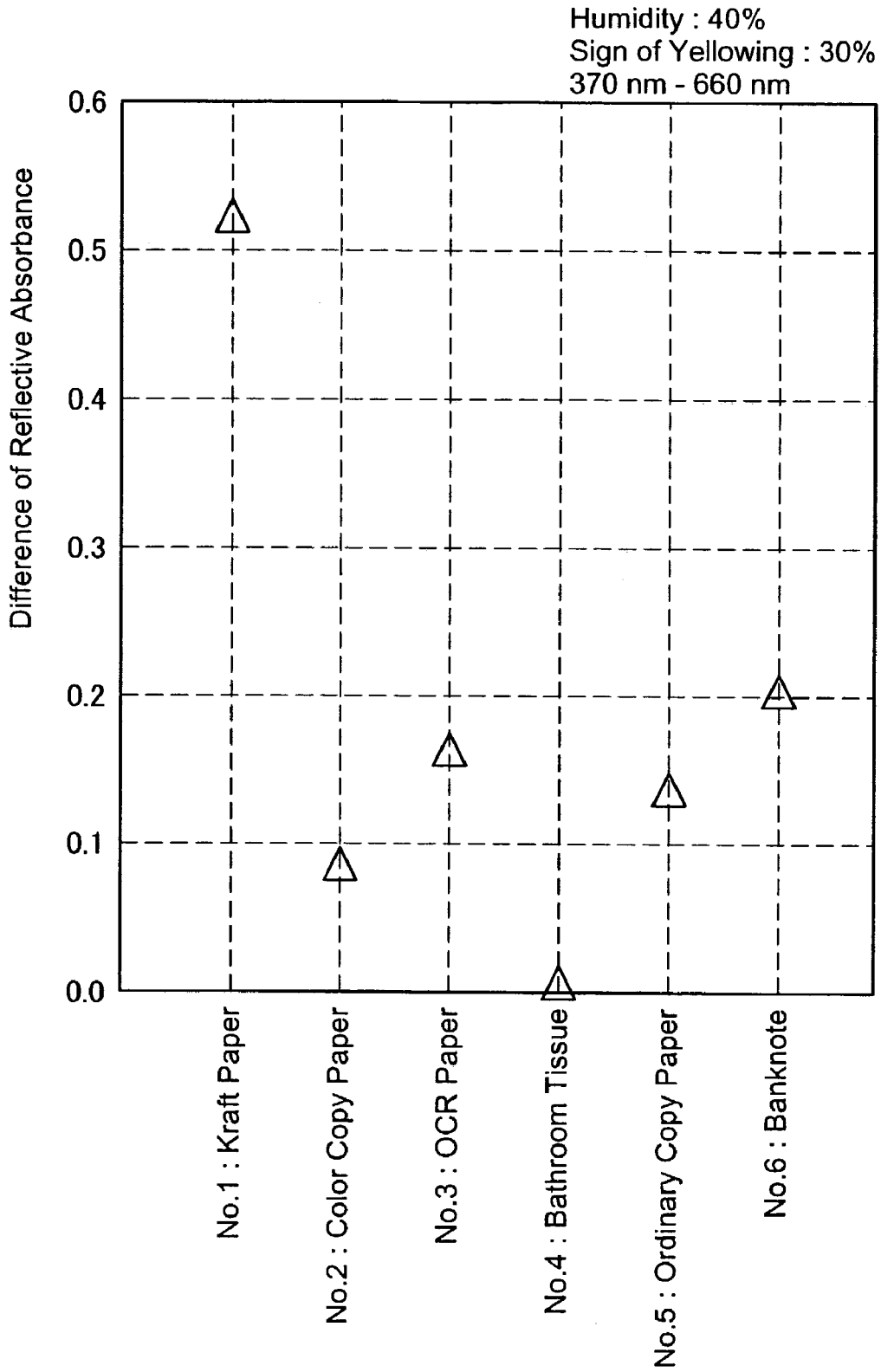
FIG. 8 is an explanatory diagram showing the effect on evaluation values in the case of varying sign of yellowing.

FIG. 7 is an explanatory diagram showing the influence on the evaluation values in the case of varying humidity. The experimental result at a humidity of 90% is shown, contrasting to being shown the result at a humidity of 40% in FIG. 3. FIG. 8 is an explanatory diagram showing the influence on the evaluation values in the case of varying the sign of yellowing. The experimental result at a yellowing of 30% is shown, contrasting to being shown the result for new sheets, at no yellowing, in FIG. 3. According to FIGS. 7 and 8, the evaluation values of this embodiment enable the identification of the paper material free from the influence due to the variation in the humidity and the sign of yellowing.

Figure 9:
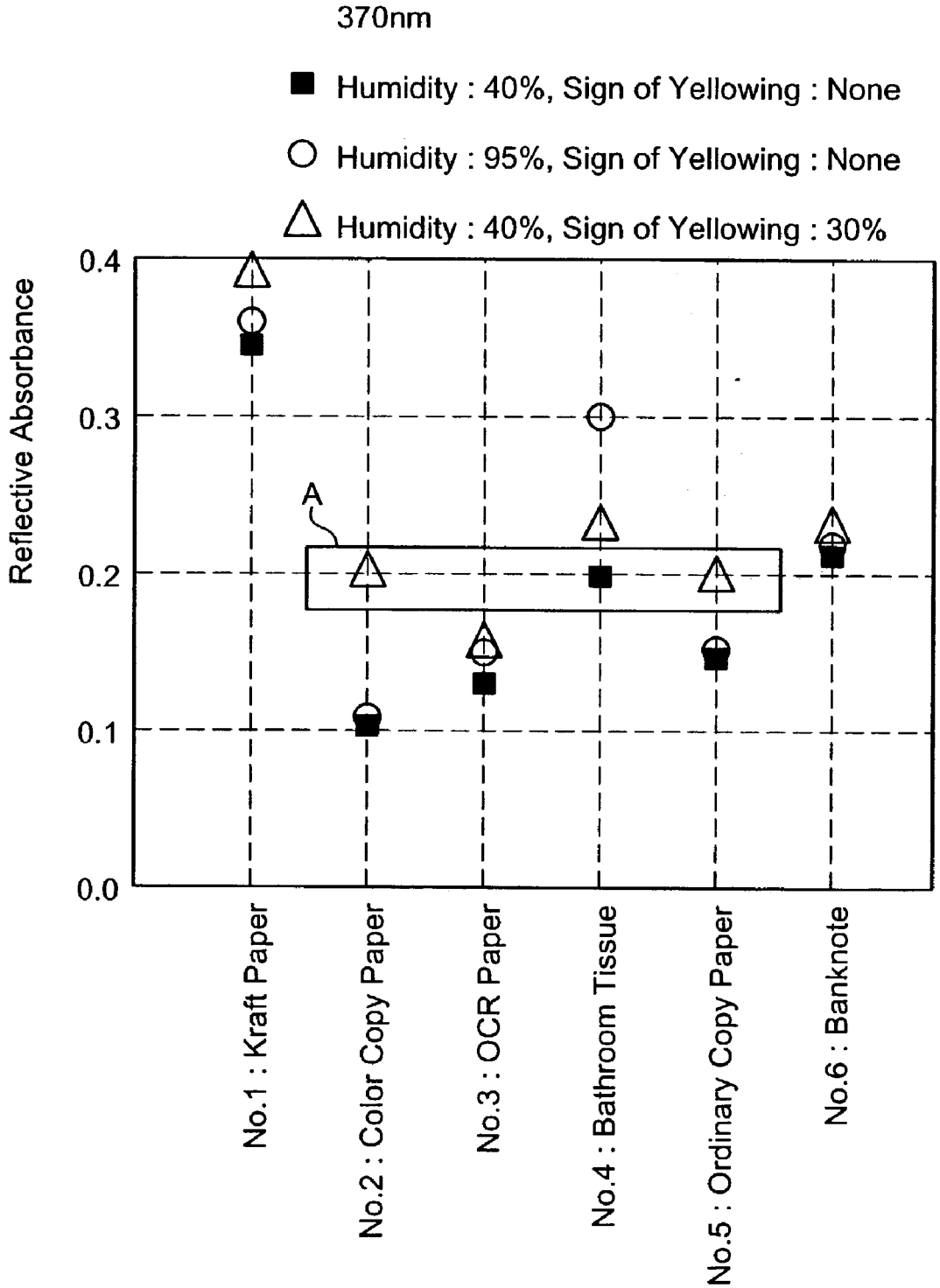
FIG. 9 is an explanatory diagram showing experimental result as a comparative example.

FIG. 9 is an explanatory diagram showing experimental result as a comparative example. The example shows that the identification of the paper material is performed simply employing the absorbance for the short-wavelength light whose center wavelength is 370 nm. Solid-box-marks indicate the results under the same conditions as those of FIG. 3: new papers, at a humidity of 40%. Under those conditions, it turns to be possible to identify the paper material by employing the short-wavelength light only. Circle-marks indicate the results under the same conditions as those of FIG. 7: new papers, at a humidity of 95%. Triangle-marks indicate the results under the same conditions as those of FIG. 8: at a yellowing of 30%, a humidity of 40%. As shown in the figure, the variation of the conditions, such as the humidity and the sign of yellowing, significantly influence on the absorbance, thereby declining stable identification about the paper material For example, all of three data within the area A are 0.2, which are impossible to be distinguished. Therefore, the identification employing the short-wavelength light only can't be stable and accurate enough.

The paper material identifying machine discussed in this embodiment using the long-wavelength light as well as the short-wavelength light, it is possible to reduce influences that are caused by manufacturing process, environmental factors such as humidity, and deterioration of sheets, thereby resulting in stable identification of the paper material.

D. Modifications:

Although a reflection method is exemplified in the above embodiment, it is applicable to employ a transmission method that detects absorbance based on transmitted light through a sheet.

A variety of methods may be defined for calculating evaluation values. For example, a weighting factor may be multiplied at least one out of the two absorbance, A1 and A2 to calculate the evaluation value, as follows.

$$\text{Evaluation Value } DAm = A1 - Ca \cdot A2;$$

$$Ca = \text{arbitrary positive number};$$

The evaluation value may be also defined as an extinction quotient as follows.

$$\text{Evaluation Value } Ar = A1/A2;$$

Certainly, further coefficient may be multiplied to the above evaluation values DAm and Ar. The evaluation values may be defined by the arithmetic expression including one of DAm or Ar, or both of them.

In the embodiment, short-wavelength light whose center wavelength is 370 nm and long wavelength light whose center wavelength is in the range of 420 to 1000 are employed. It is also applicable to employ more than two kinds of the irradiated light. The wavelength of the irradiated light is settable in various manners corresponding to the paper material to be identified. In general, when the center wavelength is around 370 nm, which is included in the ultraviolet range, the absorbance peculiar to binder that adheres fabric composing a sheet arises, thereby tending to easily detect the difference in the absorbance depending on the paper material. The absorbance for the light in the range of 420 to 1000, which is included in the visible light or the infrared light range, tends to be less influenced by the variation of the paper material, such as sign of yellowing, caused by deterioration and worn-out of sheets. The absorbance for the light under the range of 1000 nm tends to be less sensitive by humidity It is preferable to select the irradiated light in view of those tendencies, for example, by combining the ultraviolet light with the visible light or the infrared light. Further, it is preferable to include the light whose center wavelength is 370 nm or the light whose center wavelength is in the range of 420 to 1000 nm.

In the embodiment, the paper material identifying machine for identifying banknotes is exemplified, however, it is not restrictive to the banknotes but may be applicable for various kinds of sheets, for example, a lot ticket such as lottery, a ballot ticket of bike race, horse race or boat race, an admission ticket, a utility ticket of highway, telephone or various facilities, various securities, credit obligation, stock certificate and book coupon. In addition, the paper material identifying machine in the present invention may be employed not only for the purpose of any identification processing about sheets genuine or counterfeit, but also for analysis in the paper material of the sheet to be identified.

The above embodiments are to be considered in all aspects as illustrative and not restrictive. There may be many modifications, changes, and alterations without departing from the scope or spirit of the main characteristics of the present invention. For example, a processing of the paper material identification discussed above may be attained by the hardware construction as well as the software configuration.

The paper material identifying machine in accordance with the present invention prevents effects caused by manufacturing process, environmental factors such as moisture content and depleted sheets, thereby resulting in stable identification about the paper material.

What is claimed is:

1. A paper material identifying machine for identifying paper material comprising:

a first irradiating module irradiating first irradiated light to paper to be identified, the first irradiated light included in a first waveband;

a second irradiating module irradiating second irradiated light to the paper, the second irradiated light included in a second waveband different from the first waveband;

a first detecting module detecting a luminous intensity of first reflected light or first transmitted light, the first reflected light reflected from the paper by irradiating the first irradiated light to the paper, the first transmitted light transmitted through the paper by irradiating the first irradiated light to the paper;

a second detecting module detecting luminous intensity of second reflected light or second transmitted light, the second reflected light reflected from the paper by irradiating the second irradiated light to the paper, the second transmitted light transmitted through the paper by irradiating the second irradiated light to the paper;

a measuring module measuring a first ratio and a second ratio, the first ratio defined as a ratio between the intensity of the first irradiated light and that of the light detected by the first detecting module, the second ratio defined as a ratio between the intensity of the second irradiated light and that of the light detected by the second detecting module; and an identification module identifying the paper material of the paper by comparing an evaluation value, defined by the first ratio and the second ratio, with prescribed standard values, wherein the evaluation value is defined by a following formula DA;

$$DA=A1-Ca\cdot A2;$$

$$A1=L1/L10 \text{ or } A1=\log(L1/L10)$$

$$A2=L2/L20 \text{ or } A1=\log(L2/L20)$$

L10: representing the intensity of the first irradiated light

L20: representing the intensity of the second irradiated light

L1: representing the intensity of the first reflected light or the first transmitted light L2: representing the intensity of the second reflected light or the second transmitted light Ca: a parameter (arbitrary value).

2. A paper material identifying machine in accordance with claim 1, wherein the first irradiated light includes short-wavelength light within the ultraviolet light range, and the second irradiated light includes long-wavelength light within the visible light or the infrared light range.

3. A paper material identifying machine in accordance with claim 2, wherein the center wavelength of the short-wavelength light is in the range of 370± nm.

4. A paper material identifying machine in accordance with claim 2, wherein the center wavelength of the long-wavelength light is in the range of 420 to 1000 nm.

* * * * *